US006644150B2

(12) United States Patent
Chen

(10) Patent No.: US 6,644,150 B2
(45) Date of Patent: Nov. 11, 2003

(54) TOOL BIT HOLDING DEVICE WITH AN IMPROVED RETAINING EFFECT

(76) Inventor: Tsai-Ching Chen, No. 13-1, Dong Shih Hsiang, Lu Gang Chen, Chang Hua Hsien (TW)

( * ) Notice: Subject to any disclaimer, the term of this patent is extended or adjusted under 35 U.S.C. 154(b) by 45 days.

(21) Appl. No.: 10/057,716

(22) Filed: Jan. 25, 2002

(65) Prior Publication Data

US 2003/0140744 A1 Jul. 31, 2003

(51) Int. Cl.[7] ..... B25B 13/06
(52) U.S. Cl. ..... 81/438; 81/121.1
(58) Field of Search ..... 81/438, 439, 180.1, 81/121.1

(56) References Cited

U.S. PATENT DOCUMENTS 3,739,825 A * 6/1973 Knox ..... 81/451
5,938,212 A * 8/1999 Wadsworth ..... 279/42
RE36,797 E * 8/2000 Eggert et al.
6,520,509 B1 * 2/2003 Vasudeva et al. ..... 279/145

* cited by examiner

*Primary Examiner*—Lee D. Wilson
(74) *Attorney, Agent, or Firm*—Alan D. Kamrath; Rider Bennett, LLP.

(57) ABSTRACT

A tool bit holding device comprises an inner tube, an outer tube, and a clip. The inner tube includes an end and a compartment proximate the end. The inner tube includes an annular groove defined in an outer periphery thereof. A bottom wall defining the annular groove includes at least one slot to thereby communicate the annular groove with the compartment. The outer tube is mounted around the inner tube and slidable along a longitudinal direction of the inner tube. The clip is mounted in the annular groove of the inner tube, The clip includes at least one rectilinear section that is received in the slot and thus partially received in the compartment.

19 Claims, 7 Drawing Sheets

TOOL BIT HOLDING DEVICE WITH AN IMPROVED RETAINING EFFECT

BACKGROUND OF THE INVENTION

1. Field of the Invention

The present invention relates to a tool bit holding device with an improved retaining effect.

2. Description of the Related Art

FIG. 7 of the drawings illustrates a conventional tool bit holding device comprising an inner tube 20' and an outer tube 30'. A compartment 11' is defined in an end of the inner tube 20' for receiving an end of a tool bit. A transverse hole 90' is defined in the end of the inner tube 20' and communicated with the compartment 11'. A ball 80' is received in the transverse hole 90' and partially engaged in a retaining groove defined in an outer periphery of the end of the tool bit, thereby retaining the tool bit in the compartment 11'. However, the retaining effect provided by the ball 80' was found unsatisfactory such that the tool bit was apt to become disengaged from the compartment 11' during operation and thus cause accidents.

SUMMARY OF THE INVENTION

An object of the present invention is to provide a tool bit holding device with an improved retaining effect to thereby prevent undesired disengagement of the tool bit from the tool bit holding device during operation.

In accordance wit a first aspect of the invention, a tool bit holding device is provided and comprises an inner tube, an outer tube, and a clip. The inner tube includes an end and has a compartment. The inner tube includes an annular groove defined in an outer periphery thereof. A bottom wall defining the annular groove includes at least one slot to thereby communicate the annular groove with the compartment. The outer tube is mounted around the inner tube and slidable along a longitudinal direction of the inner tube. The clip is mounted in the annular groove of the inner tube. The clip includes at least one rectilinear section that is received in the slot and thus partially received in the compartment.

In accordance with a second aspect of to invention, a combination of a tool bit and a tool bit holding device is provided and comprises an inner tube, an outer tube, a clip, and a tool bit. The inner tube includes an end and has a compartment. The inner tube includes an annular groove defined in an outer periphery thereof. A bottom wall defining the annular groove includes at least one slot to thereby communicate the annular groove with the compartment. The outer tube is mounted around the inner tube and slidable along a longitudinal direction of the inner tube. The clip is mounted in the annular groove of the inner tube. The clip includes at least one rectilinear section that is received in the slot and thus partially received in the compartment. The tool bit has an end releasably received in the compartment of the inner tube. The rectilinear section of the clip exerts a radially inward force to the end of the tool bit, thereby securely retaining the tool bit in place.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
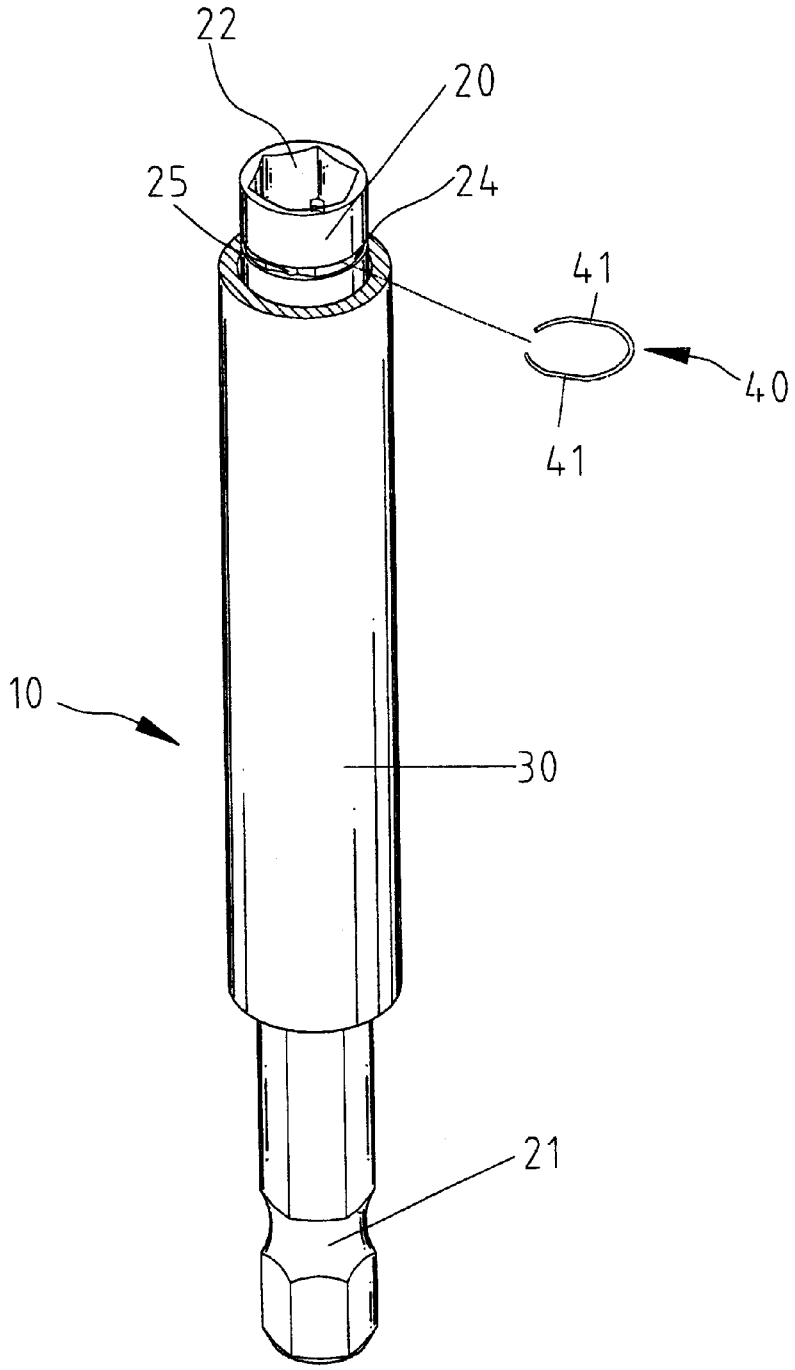
FIG. 1 is a perspective view, partly cutaway, of a tool bit holding device in accordance with the present invention.
Figure 2:
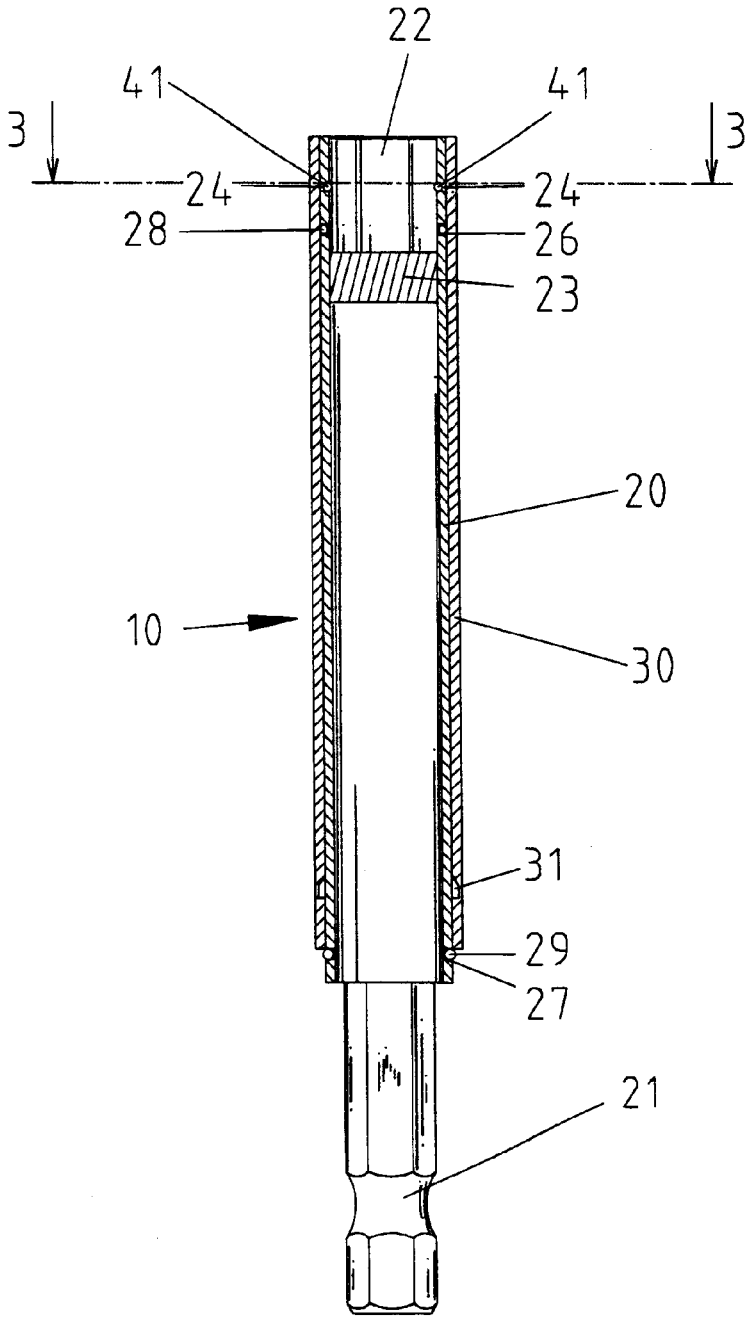
FIG. 2 is a sectional view of the tool bit holding device in accordance with the present invention.

Referring to FIGS. 1 and 2, a tool bit holding device 10 in accordance with the present invention generally comprises an inner tube 20 and an outer tube 30 mounted around the inner tube 20 and slidable along a longitudinal direction of the inner tube 20. The inner tube 20 includes a first end having a quick coupler 21 and a second end in which a compartment 22 is defined. The quick coupler 21 is substantially hexagonal and may be engaged with a pneumatic tool. A bottom wall defining the compartment 22 includes a magnetic member 23 or a magnet.

Figure 3:
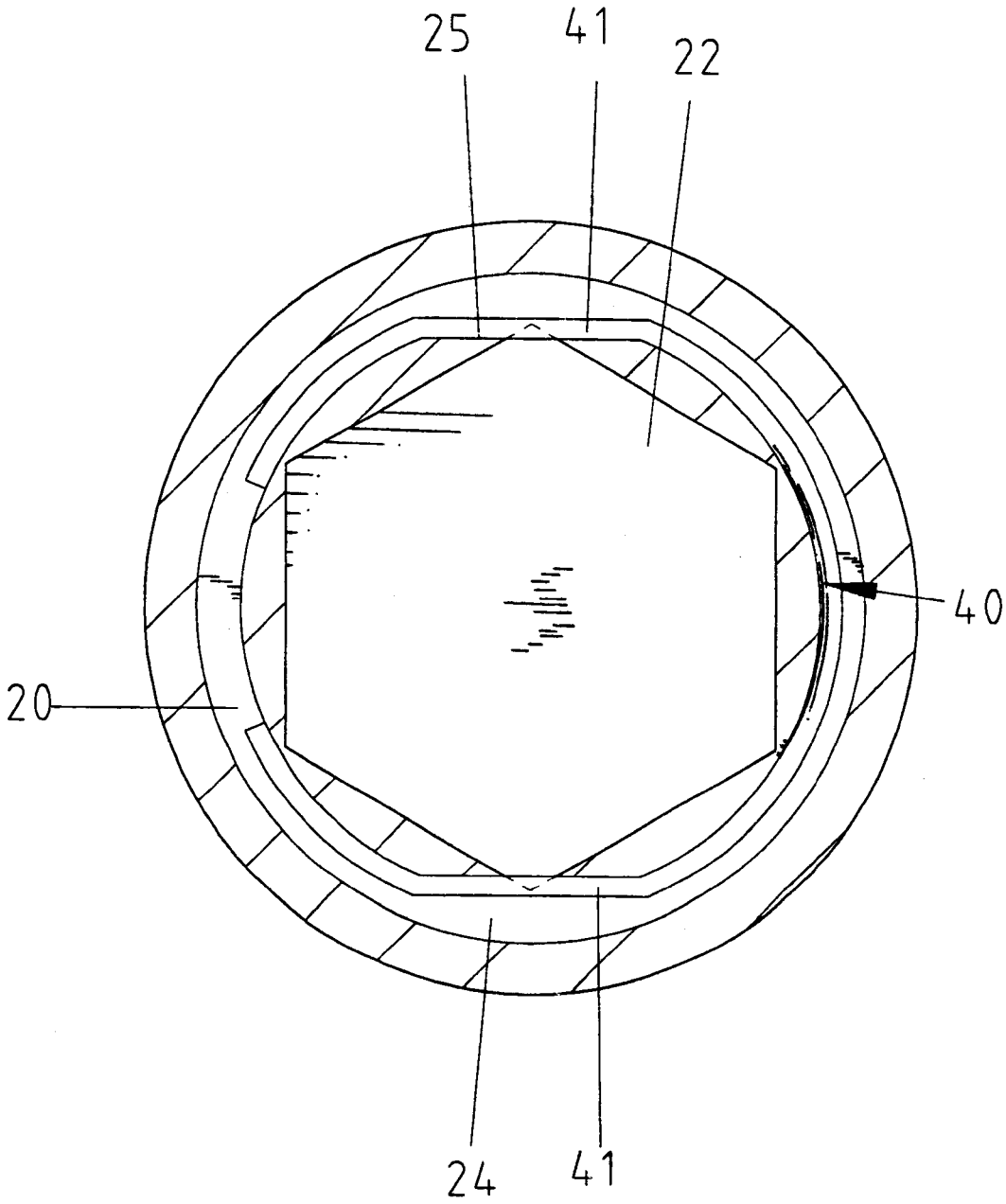
FIG. 3 is a sectional view, in an enlarged scale, taken along plane 3—3 in FIG. 2.

The second end of the inner tube 20 further includes an annular groove 24 in an outer periphery thereof. A bottom wall defining the annular groove 24 includes at least one rectilinear slot 25 for communicating the compartment 22 with the annular groove 24. In this embodiment, the bottom wall defining the annular groove 24 includes two diametrically disposed rectilinear slots 25, best shown in FIG. 3.

Referring to FIG. 2, the inner tube 20 further includes an annular positioning groove 26 defined in the outer periphery thereof and located in the second end thereof. A retainer ring 28 is received in the annular positioning groove 26. Further, the inner tube 20 includes an annular positioning groove 27 in the outer periphery thereof and located in the first end thereof. A retainer ring 29 is received in the annular positioning groove 27. The retainer rings 28 and 29 limit the longitudinal sliding motion of the outer tube 30 along the outer periphery of the inner tube 20.

The outer tube 30 includes a first end and a second end. An annular groove 31 is defined in an inner periphery of the outer tube 30 and located in the second end of the outer tube 30. When the annular groove 31 is moved to the retainer ring 28, the outer tube 30 is stopped by the retainer ring 28 to prevent further sliding movement of the outer tube 30, which is conventional and therefore not described in detail.

A substantially C-shaped clip 40 is mounted in the annular groove 24 of the inner tube 20. The clip 40 includes at least one rectilinear section 41. In this embodiment, the clip 40 includes two diametrically disposed rectilinear sections 41 (FIG. 1) that are respectively located in the rectilinear slot 25 and thus partially received in the compartment 22 of the inner tube 20.

Figure 4:
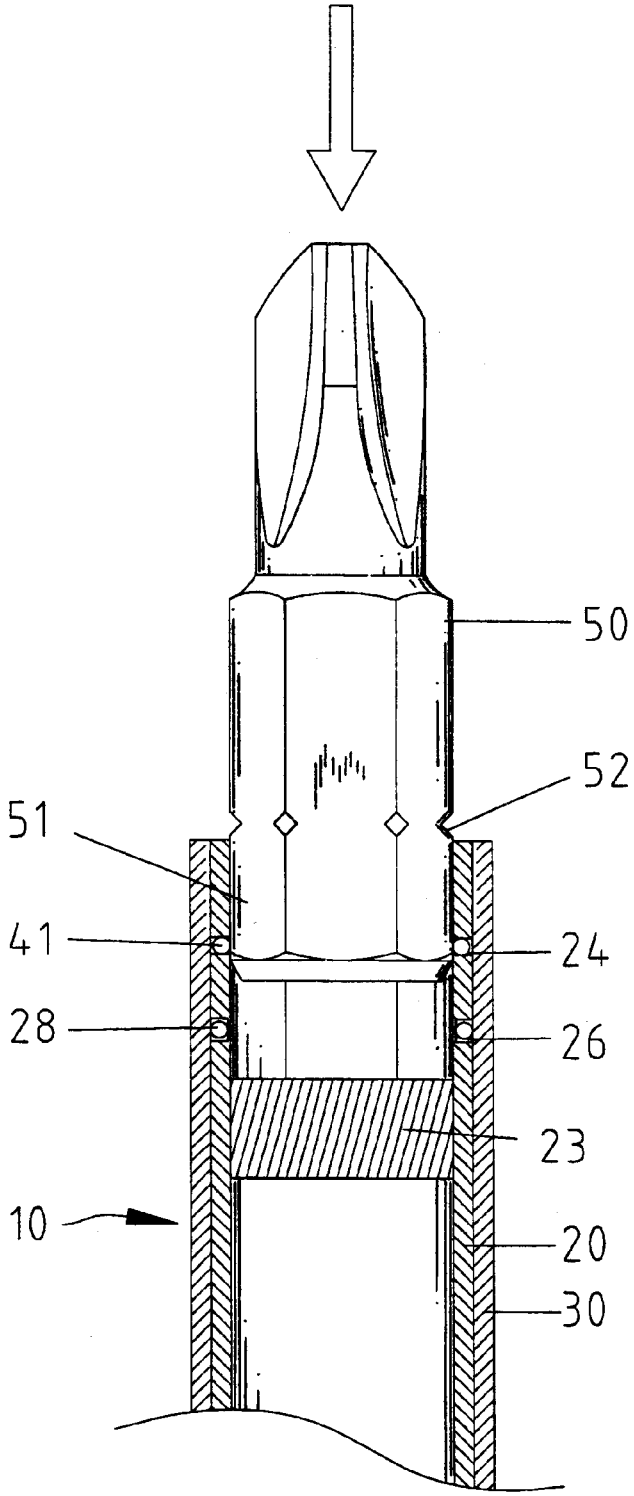
FIG. 4 is a partial sectional view illustrating engagement of a tool bit and the tool bit holding device in accordance with the present invention.
Figure 5:
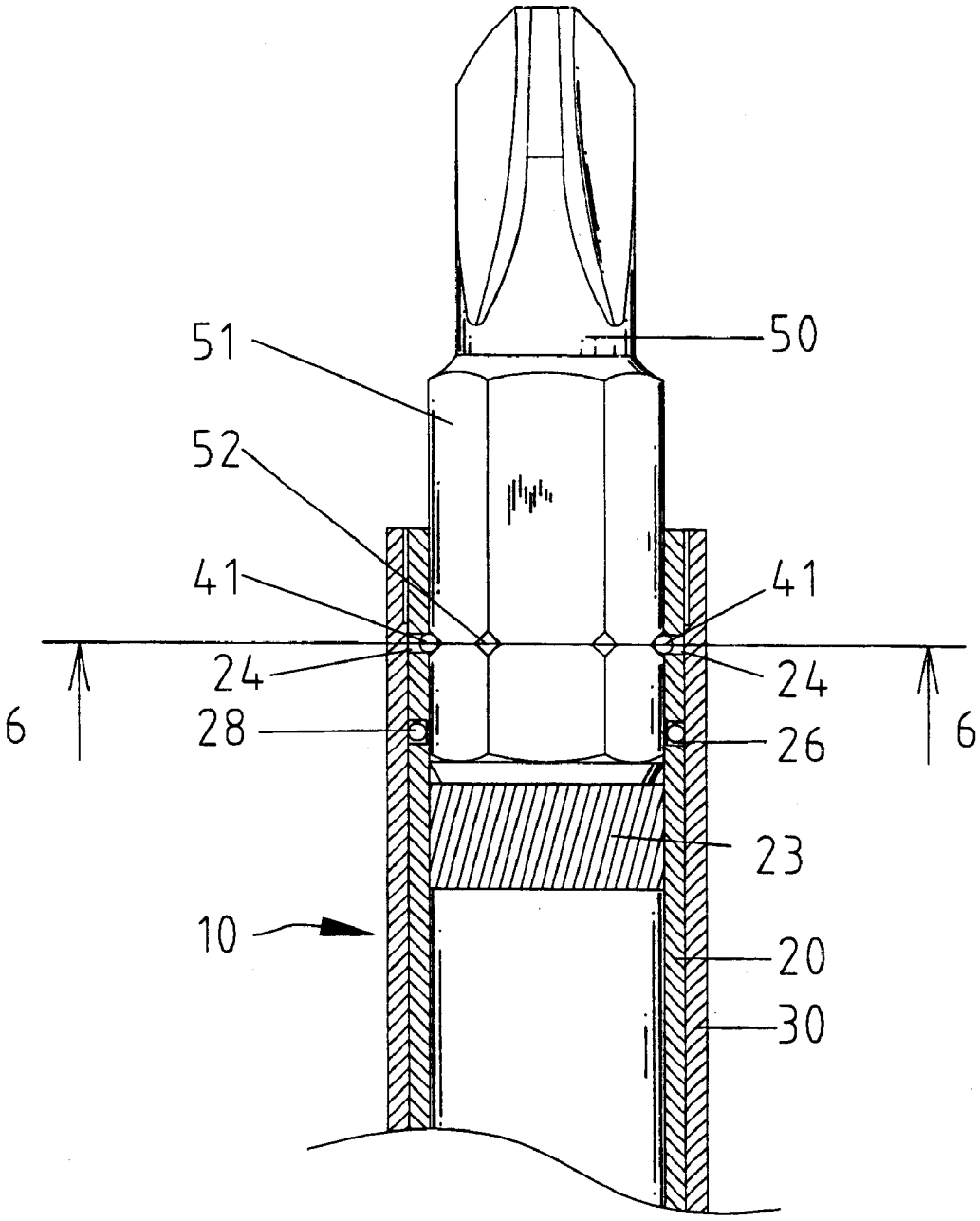
FIG. 5 is a sectional view similar to FIG. 4, wherein an end of the tool bit is engaged in the tool bit holding device.
Figure 6:
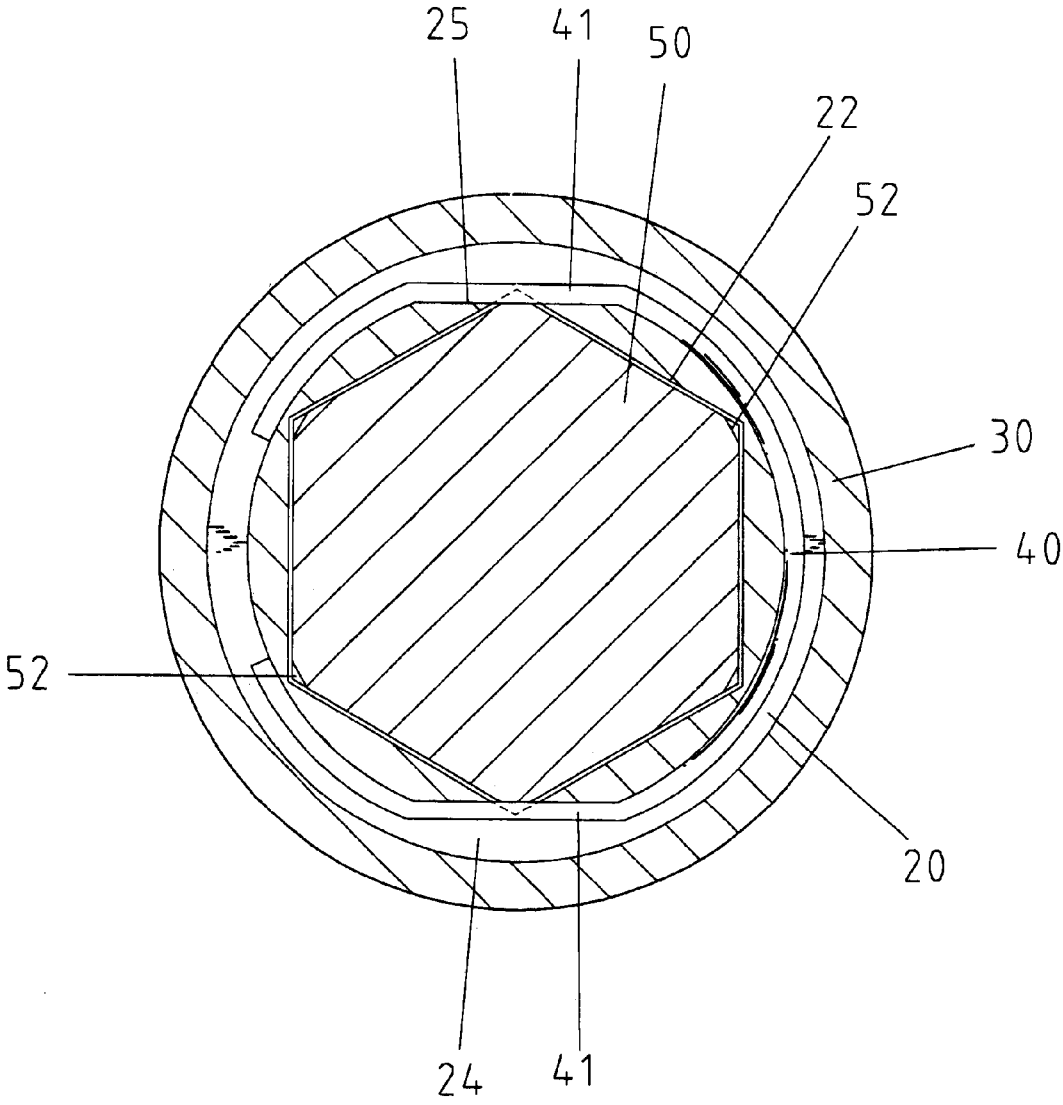
FIG. 6 is a sectional view, in an enlarged scale, taken along plane 6—6 in FIG. 5.
Figure 7:
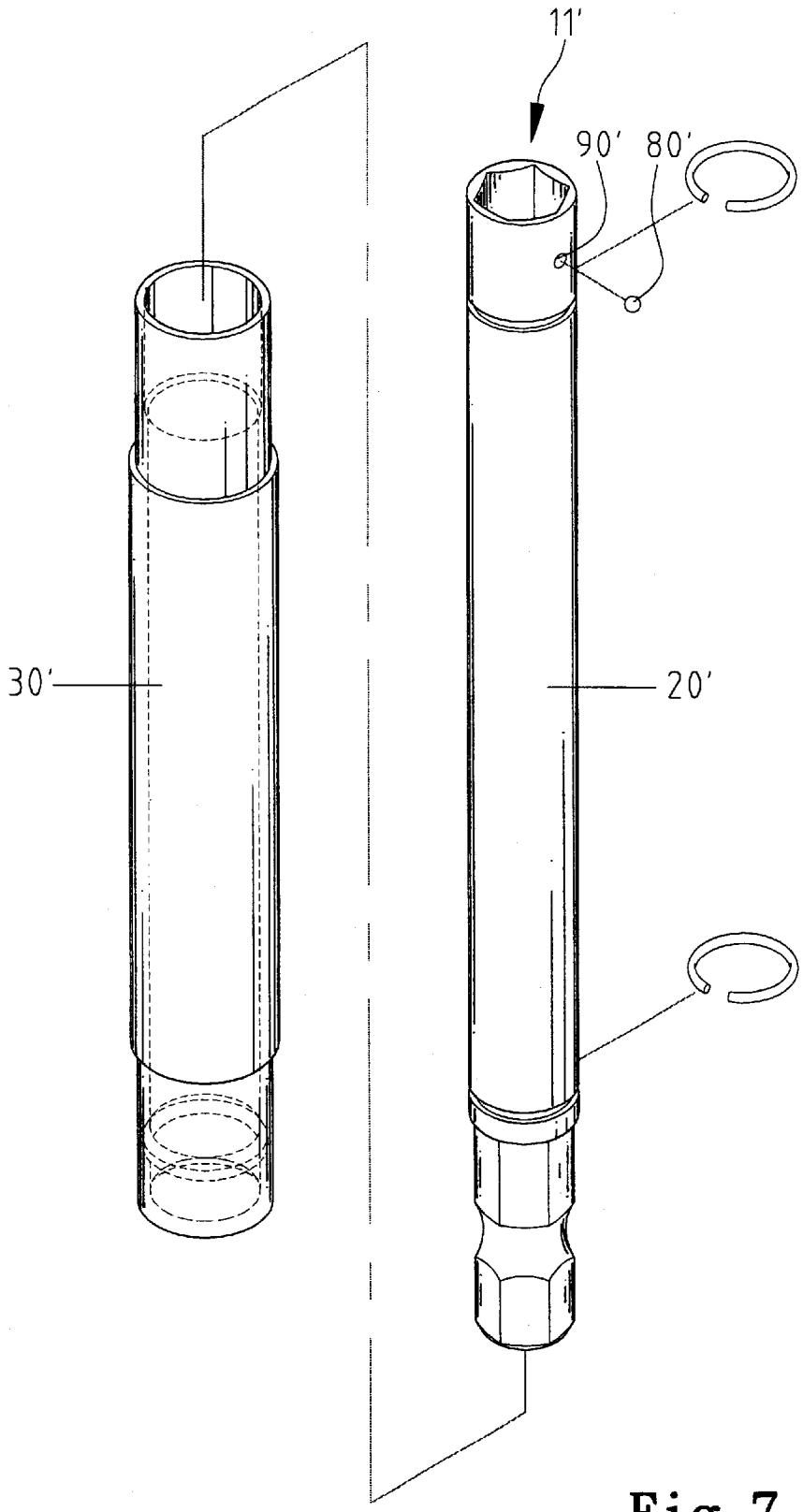
Fig. 7 PRIOR ART
FIG. 7 is an exploded perspective view of a conventional tool bit holding device.

Referring to FIG. 4, when engaging a tool bit 50 wit the tool bit holding device in accordance with the present invention, an end 51 (generally hexagonal) of the tool bit 50 is inserted into the compartment 22 of the inner tube 20. The rectilinear sections 41 of the clip 40 are pushed outward by the end 51 of the tool bit 50. When the end 51 of the tool bit 50 is received in the compartment 22 (FIG. 5), the rectilinear sections 41 of the clip 40 exert a radially inward force to the end 51 of the tool bit 50 and are thus securely engaged in a retaining groove 52 in an outer periphery of the end 51 of the tool bit 50. Thus, the end 51 of the tool bit 50 is securely retained in the compartment 22 of the inner tube 20, best shown in FIG. 6. The magnetic member 23 in the inner tube 20 attracts the end 51 of the tool bit 50 and thus provides an extra retaining effect.

Thus, the end 51 of the tool bit 50 is securely engaged in the compartment 22 of the inner tube 20 during operation of the tool bit 50. Operation of the tool bit holding device is conventional and therefore not described in detail.

Although the invention has been explained in relation to its preferred embodiment, it is to be understood that many other possible modifications and variations can be made without departing from the scope of the invention as hereinafter claimed.

What is claimed is:

1. A tool bit holding device comprising:

an inner tube including an end and having an inner periphery, an outer periphery, and a compartment, with the compartment being proximate the end and defined by the inner periphery of the inner tube, with the inner tube including an annular groove defined in the outer periphery thereof, with the annular groove having a bottom wall located intermediate the inner periphery and the outer periphery, with the bottom wall defining the annular groove and including at least one slot extending from the annular groove to the inner periphery to thereby communicate the annular groove with the compartment;

an outer tube mounted around the inner tube and slidable along a longitudinal direction of the inner tube; and a clip mounted in the annular groove of the inner tube, the clip including at least one section that is received in said at least one slot and thus partially received in the compartment.

2. The tool bit holding device as claimed in claim 1, wherein the inner tube includes a quick coupler on another end thereof for engaging with a pneumatic tool.

3. The tool bit holding device as claimed in claim 1, wherein each of the end and another end of the inner tube comprises an annular positioning groove for receiving a retainer ring to thereby limit longitudinal sliding movement of the outer tube relative to the inner tube.

4. The tool bit holding device as claimed in claim 3, wherein the outer tube includes an annular groove in an end of an inner periphery thereof, the outer tube being stopped by an associated one of the retainer rings when the annular groove of the outer tube is moved to the associated retainer ring.

5. The tool bit holding device as claimed in claim 1, wherein a bottom wall defining the compartment of the inner tube includes a magnetic member.

6. The tool bit holding device as claimed in claim 1, wherein said at least one section of the clip is rectilinear.

7. The tool bit holding device as claimed in claim 6, wherein said at least one slot is rectilinear.

8. The tool bit holding device as claimed in claim 1, wherein said at least one slot is rectilinear.

9. A tool bit holding device comprising:

an inner tube including an end and having a compartment, the end of the inner tube including an annular groove defined in the outer periphery thereof, a bottom wall defining the annular groove including at least one slot to thereby communicate the annular groove with the compartment, wherein said at least one slot is rectilinear;

an outer tube mounted around the inner tube and slidable along a longitudinal direction of the inner tube; and a clip mounted in the annular groove of the inner tube, the clip including at least one rectilinear section that is received in said at least one slot and thus partially received in the compartment.

10. A combination of a tool bit and a tool bit holding device, the combination comprising:

an inner tube including an end and having an inner periphery, an outer periphery; and a compartment, with the compartment being proximate the end and defined by the inner periphery of the inner tube, with the inner tube including an annular groove defined in the outer periphery thereof, with the annular groove having a bottom wall located intermediate the inner periphery and the outer periphery, with the bottom wall defining the annular groove and including at least one slot extending from the annular groove to the inner periphery to thereby communicate the annular groove with the compartment;

an outer tube mounted around the inner tube and slidable along a longitudinal direction of the inner tube;

a clip mounted in the annular groove of the inner tube, the clip including at least one section tat is received in said at least one slot and thus partially received in the compartment; and a tool bit having an end releasably received in the compartment of the inner tube;

said at least one section of the clip in contact with and exerting a radially inward force to the end of the tool bit through the slot of the annular groove, thereby securely retaining the tool bit in place.

11. The combination as claimed in claim 10, wherein the end of the tool bit includes a retaining groove in an outer periphery thereof, said at least one section of the clip being securely engaged in the retaining groove of the tool bit.

12. The combination as claimed in claim 11, wherein said at least one section of the clip is rectilinear.

13. The tool bit holding device as claimed in claim 10, wherein the inner tube includes a quick coupler on another end thereof for engaging with a pneumatic tool.

14. The tool bit holding device as claimed in claim 10, wherein each of the end and another end of the inner tube comprises an annular positioning groove for receiving a retainer ring to thereby limit longitudinal sliding movement of the outer tube relative to the inner tube.

15. The tool bit holding device as claimed in claim 14, wherein the outer tube includes an annular groove in an end of an inner periphery thereof, the outer tube being stopped by an associated one of the retainer rings when the annular groove of the outer tube is moved to the associated retainer ring.

16. The tool bit holding device as claimed in claim 10, wherein a bottom wall defining the compartment of the inner tube includes a magnetic member for attracting the end of the tool bit.

17. The tool bit holding device as claimed in claim 10, wherein said at least one slot is rectilinear.

18. The combination as claimed in claim 17, wherein said at least one section of the clip is rectilinear.

19. The combination as claimed in claim 10, wherein said at least one section of the clip is rectilinear.

* * * * *